US006663922B2

(12) United States Patent
Ogino et al.

(10) Patent No.: US 6,663,922 B2
(45) **Date of Patent: *Dec. 16, 2003**

(54) RECORDING MEDIUM, INK JET RECORDING METHOD USING THE RECORDING MEDIUM, AND METHOD OF PRODUCING THE RECORDING MEDIUM

(75) Inventors: Hiroyuki Ogino, Yokohama (JP); Masako Ichioka, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/572,792

(22) Filed: May 17, 2000

(65) Prior Publication Data

US 2003/0026956 A1 Feb. 6, 2003

(30) Foreign Application Priority Data

May 21, 1999 (JP) ..... 11-141969

(51) Int. Cl.[7] ..... B41M 5/00

(52) U.S. Cl. ..... 428/32.24; 428/32.18; 347/105; 427/146

(58) Field of Search ..... 428/195, 211, 428/195.1, 32.24, 32.18; 347/105; 427/146

(56) References Cited

U.S. PATENT DOCUMENTS

| | | | | |
|---|---|---|---|---|
| 4,572,847 | A | * | 2/1986 | Haruta et al. |
| 4,723,129 | A | | 2/1988 | Endo et al. ..... 346/1.1 |
| 4,927,666 | A | * | 5/1990 | Kawasaki et al. |
| 5,997,625 | A | * | 12/1999 | Londo et al. ..... 106/486 |
| 6,045,917 | A | * | 4/2000 | Missell et al. ..... 428/411.1 |
| 6,046,299 | A | * | 4/2000 | Uchida et al. ..... 528/170 |

FOREIGN PATENT DOCUMENTS

| | | |
|---|---|---|
| EP | 0 887 201 A1 | 12/1998 |
| JP | 54-59139 | 5/1979 |
| JP | 6-312572 | 11/1994 |
| JP | 11-11014 | 1/1999 |

* cited by examiner

*Primary Examiner*—Pamela R. Schwartz
(74) *Attorney, Agent, or Firm*—Fitzpatrick, Cella, Harper & Scinto

(57) ABSTRACT

In a recording medium having an ink accepting layer formed on at least one surface of a base paper, the ink accepting layer is formed in the form of islands scattered on the surface of the base paper with a uniform plane density.

8 Claims, 2 Drawing Sheets

RECORDING MEDIUM, INK JET RECORDING METHOD USING THE RECORDING MEDIUM, AND METHOD OF PRODUCING THE RECORDING MEDIUM

BACKGROUND OF THE INVENTION

1. Field of the Invention

The present invention relates to a recording medium on which an image etc. is recorded and which is suitable for use in ink jet recording. More particularly, the present invention relates to a recording medium that maintains the natural characteristics of the base paper, and ensures a high image density, a sharp color tone and a high resolution, while developing good ink absorption.

Further, the present invention relates to a method of producing the recording medium, and an ink jet recording method in which ink is ejected in the form of droplets toward the medium for recording of an image, etc. thereon.

2. Description of the Related Art

Recently, an ink jet recording method has been developed to record an image, characters and so forth by ejecting ink in the form of minute droplets according to any of various operating principles, and depositing the ink droplets on a recording medium made of, e.g., paper. The ink jet recording method has superior advantages such as high-speed operation, low noise, easy realization of multicolor recording, and versatility in recording pattern.

Because of advantageous features requiring neither development nor fixation in addition to the above advantages, the ink jet recording method has become increasingly employed in many applications, including information equipment, for recording various images. Furthermore, an image formed by the multicolor ink jet recording method is comparable in image quality to an image obtained by multicolor printing using a plate-making process and by printing using a color photographic process. In the case of recording an image etc. on a relatively small number of sheets of paper, the recording cost is lower than the cost for producing an ordinary multicolor printing image or a photographic image. For that reason, the ink jet recording method has seen more widespread use even in the field of full-color image recording as well.

In the field of ink jet recording, recording apparatuses and processes have been improved with the advance of recording characteristics such as speedup of recording operation, higher definition, and full-color recording. Correspondingly, improved characteristics have also been demanded for recording media.

The forms of recording media for use in ink jet recording are mainly divided into two types, i.e., the ordinary type represented by fine paper and bond paper, and the coated type manufactured by coating an ink accepting layer on the surface of a support formed of fine paper, synthetic paper, or a synthetic resin film. The coated type is further divided into the low-coated type having a coating weight in the range of about 1 to 10 g/m$^2$, the medium-coated type having a coating weight in the range of about 10 to 20 g/m$^2$, and the high-coated type having a coating weight not less than 20 g/m$^2$.

In the recording media for use in ink jet recording of the medium- or high-coated type using a paper-made support, because sufficient ink absorption is provided by an ink accepting layer formed as a relatively thick coating, ink diffusion (blur) in the two-dimensional directions along the surface of a recording medium is suppressed, and a high-definition, sharp image can be formed by ink jet recording. On the other hand, those recording media have the disadvantages that the natural characteristics of the base paper are lost by the presence of a relatively thick ink accepting layer (the medium-coated type having a thickness of about 10 to 20 $\mu$m), and that the recording media cannot be easily handled because of the increase in its thickness and hence in its hardness. For those reasons, recording media of the low-coated type, which do not lose the natural characteristics of the base paper and ease in handling, have been used more favorably in recent years.

For recording media of the low-coated type, however, since all of the ink ejected toward the recording medium cannot be absorbed only by an ink accepting layer, a part of the ejected ink must be absorbed by the base paper. Accordingly, the recording medium of the low-coated type has been produced by employing a base paper having a small Stökigt sizing degree and good ink absorption, and coating a thin ink accepting layer over the entire surface of the base paper.

The thus-produced recording medium of the low-coated type is less susceptible to such failures as ink flooding due to insufficient ink absorption and the so-called beading problem in which ink coheres on the surface of the medium to cause unevenness in density. On the other hand, there arise problems that ink diffuses deep into the base paper and an image recorded or printed on the recording medium becomes lighter. Furthermore, in the case of full-color printing wherein a large amount of ink is concentrated in a particular area, the thin ink accepting layer cannot sufficiently hold the ink therein. As a result, the surplus ink diffuses unevenly within the ink accepting layer formed over the entire surface of the base paper in the two-dimensional directions. This uneven diffusion of ink results in the occurrence of whisker-like smears (so-called feathering) extending radially outward from printed dots, and noticeably lowers the printing quality.

Japanese Patent Laid-Open No. 6-312572 discloses a method of trying to suppress diffusion of ink in the two-dimensional directions along the paper surface by coating a thin ink accepting layer, which has a grain size less than 1/100 of the size of pulp fibers making up the base paper, so as to completely cover the pulp fibers exposed to the surface of the base paper.

The disclosed method is effective when the amount of ink to be absorbed into the base paper is relatively small. In the case of absorbing a large amount of ink into the base paper, however, it is difficult to suppress diffusion of the ink in the two-dimensional directions along the paper surface.

Japanese Patent Laid-Open No. 11-011014 proposes a method of scattering a hydrophobic material in an ink accepting layer.

With this related art, however, the ink accepting layer must be formed in a relatively thick thickness on the surface of the base paper. Accordingly, the proposed method cannot ensure the retention of the natural characteristics of the base paper and ease in handling as intended by the present invention.

SUMMARY OF THE INVENTION

With the view of solving the problems set forth above, an object of the present invention is to provide a recording medium that maintains the natural characteristics of the base paper, and ensures a high image density, a sharp color tone and a high resolution by suppressing diffusion of ink in the two-dimensional directions along the paper surface, while developing good ink absorption.

To achieve the above object, according to the present invention, in a recording medium having an ink accepting layer formed on at least one surface of a base paper, the ink accepting layer is formed in the form of islands scattered on the surface of the base paper.

DESCRIPTION OF THE PREFERRED EMBODIMENTS

Figure 1:
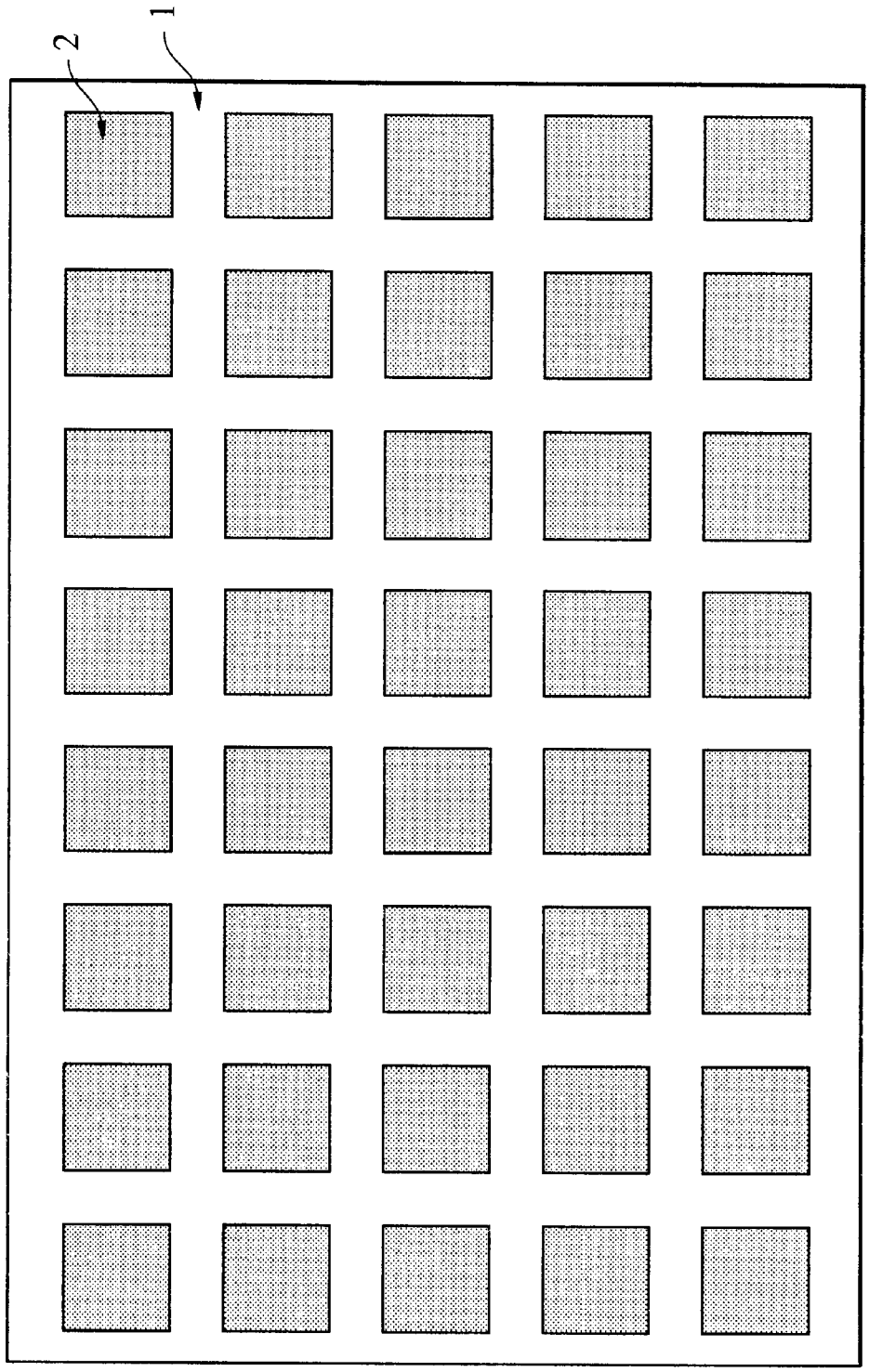
FIG. 1 is an enlarged view schematically showing one exemplary surface state of a recording medium according to the present invention.

The recording media of the low-coated type have the problem that an ink accepting layer coated over the entire surface of the base paper is very thin, and hence, has very little ink absorptivity. In the case where a large amount of ink is ejected to be concentrated in a small area, as occurs in full-color printing, for example, the ink diffuses within the ink accepting layer coated over the base paper in the two-dimensional directions, and noticeably lowers the printing quality. Also, although the ink accepting layer is coated as a thin film, the natural characteristics of the base paper and ease in handling are noticeably impaired because the ink accepting layer is coated over the entire surface of the base paper.

According to the present invention, diffusion of ink in the two-dimensional directions along the paper surface can be suppressed by forming an ink accepting layer in a pattern of scattered islands so that the ink diffusion in the two-dimensional directions along the paper surface is restricted to occur only within the individual "islands" of the ink accepting layer.

Multiple types of ink accepting layers may exist on the base paper, and each of these multiple types of ink accepting layers may be formed in the form of islands scattered on the surface of the same base paper. This means that the multiple types of ink accepting layers are scattered in the form of islands on the surface of the same base paper. A combination of the types of ink accepting layers and a mixing ratio of the types used are determined in consideration of the ink absorptivity of the recording medium.

The amount of the ink accepting layer coated on the base paper is preferably in the range of 0.1 to 10 g/m$^2$, more preferably in the range of 1 to 5 g/m$^2$. In the case of using multiple types of ink accepting layers, it is desired that the total amount of the ink accepting layers satisfies the above conditions.

If the total amount of the ink accepting layer(s) is not less than 0.1 g/m$^2$, the ink accepting layer exists on the base paper in a sufficient amount, and therefore the image density is kept from becoming lighter. If the total amount of the ink accepting layer(s) is not more than 10 g/m$^2$, the natural characteristics of the base paper are kept from disappearing due to an excessive amount of the ink accepting layer coating.

Assuming that the size of the islands of the ink accepting layer is represented by a mean value of long and short axes of each island of the ink accepting layer, the mean value of the sizes (i.e., a mean size) of 200 islands of the ink accepting layer is preferably in the range of 3 to 250 $\mu$m, more preferably in the range of 5 to 100 $\mu$m.

If the mean size is not less than 3 $\mu$m, scattering of light reflected from the paper surface can be suppressed and the natural characteristics of the base paper can be maintained. If the mean size is not more than 250 $\mu$m, diffusion of ink within the ink accepting layer in the two-dimensional directions along the paper surface is not conspicuous and the resolution of the printed image is improved.

The coverage ratio of the total area of the ink accepting layer to the surface area of the base paper is generally in the range of 20 to 80%. Preferably, the coverage is not less than 30% but less than 70%. If the coverage is too small, there is a possibility that the image density may become lighter. If the coverage is too large, there is a possibility that the natural characteristics of the base paper may be impaired. More preferably, the coverage is not less than 50% but less than 70%. It is also preferable that the ink accepting layer in the form of scattered islands be present on the paper surface with a uniform plane density.

Various materials can be selected for the ink accepting layer in consideration of the type of ink used. In general, a material containing at least two kinds of ingredients, i.e., an inorganic pigment and a binder, taking into account fixation and absorption of the ink is used. Especially preferable examples of the inorganic pigment are alumina hydrate and silica. Also, as the binder, one or more kinds of water-soluble high-molecular weight polymers and water-dispersant high-molecular weight polymers are preferably employed.

Further, a mixing ratio of the inorganic pigment to the binder is preferably in the range of 5:1 to 20:1 by weight. If the amount of binder is too high, the pore volume in the ink accepting layer would be so reduced as to lower the ink absorptivity. Conversely, if the amount of binder is too small, forces for coagulating the pigment would become so weak as to cause the phenomenon of the so-called "powder dropping", wherein the pigment peels off from the ink accepting layer.

Various materials can be selected for the base paper in consideration of the ink absorptivity of the ink accepting layer and the properties of the ink used. In general, so long as the paper employed as the base paper has a Stökigt sizing degree in the range of 5 to 2000 seconds (calculated in terms of bulk weight of 127 g/m$^2$), the advantages of the present invention are obtained. To sufficiently develop the advantages of the present invention, however, it is preferable to employ, as the base paper, paper having a Stökigt sizing degree in the range of 10 to 400 seconds calculated in terms of bulk weight of 127 g/m$^2$.

A recording medium having the above-described features is preferably employed with ink jet recording methods wherein minute ink droplets are ejected through fine orifices and deposited on the recording medium. Of those ink jet recording methods, the above-described recording medium is especially preferably employed with the method wherein ink is heated and minute ink droplets are ejected upon volumetric expansion of the ink.

Ink used in the ink jet recording methods preferably contains at least a coloring material (pigment or dye), a water-soluble organic solvent, and water.

A method of forming the ink accepting layer on the base paper can be optionally selected. In particular, the ink accepting layer is preferably formed on the base paper by a pattern printing method (for example, screen printing, flexography, gravure, etc.).

The base paper used in the present invention is preferably a sheet of paper containing fibrous pulp as a main ingredient. Generally commercially available fine paper or the like is usable as the base paper. For example, the base paper can be manufactured from raw materials for papermaking, which contain pulp fibers and a filler as main ingredients, in accordance with an ordinary process. Any type of fibrous pulp can be used without particular limitation so long as it is employed in usual papermaking. Examples of usable fibrous pulp include chemical pulp represented by broadleaf-tree bleached kraft pulp (hereinafter abbreviated as "LBKP"), needle-leaf-tree bleached kraft pulp (hereinafter abbreviated as "NBKP") and so on, mechanical pulp, recycled paper, non-wood pulp, a mixture thereof, etc.

Original paper can be manufactured, for example, by an ordinary process for making paper using pulp fibers and a filler as main ingredients, and other papermaking aids, e.g., a sizing agent, as needed.

Examples of the filler include calcium carbonate, kaolin, talc, titanium dioxide, and so on. An especially preferable filler is kaolin.

Materials usable as the sizing agent are, for example, a rosin size, alkylketene dimers, alkenyl succinic anhydrides, petroleum resin-base sizes, epichlorohydrin, and acrylic amides.

The Stökigt sizing degree of the base paper used in the present invention is, though not particularly limited, preferably adjusted to fall in the range of 10 to 400 seconds calculated in terms of bulk weight of 127 g/m$^2$. If the Stökigt sizing degree is too high, the ink absorptivity would be insufficient in some cases. Conversely, if the Stökigt sizing degree is too low, a reduction of the image density would occur in some cases.

The ink accepting layer coated on the base paper in the present invention will be next described.

In recording medium of the present invention, the ink accepting layer is scattered in the form of islands on the surface of the base paper. The recording medium of the present invention can maintain the natural characteristics of the base paper and ease in handling with fidelity. Further, even in the case of employing a base paper that has a high Stökigt sizing degree and hence poor ink absorptivity, because the ink accepting layer exists in the form of islands, diffusion of ink in the two-dimensional directions along the paper surface is restricted within the individual islands of the ink accepting layer, whereby a high-quality image is obtained.

Figure 2:
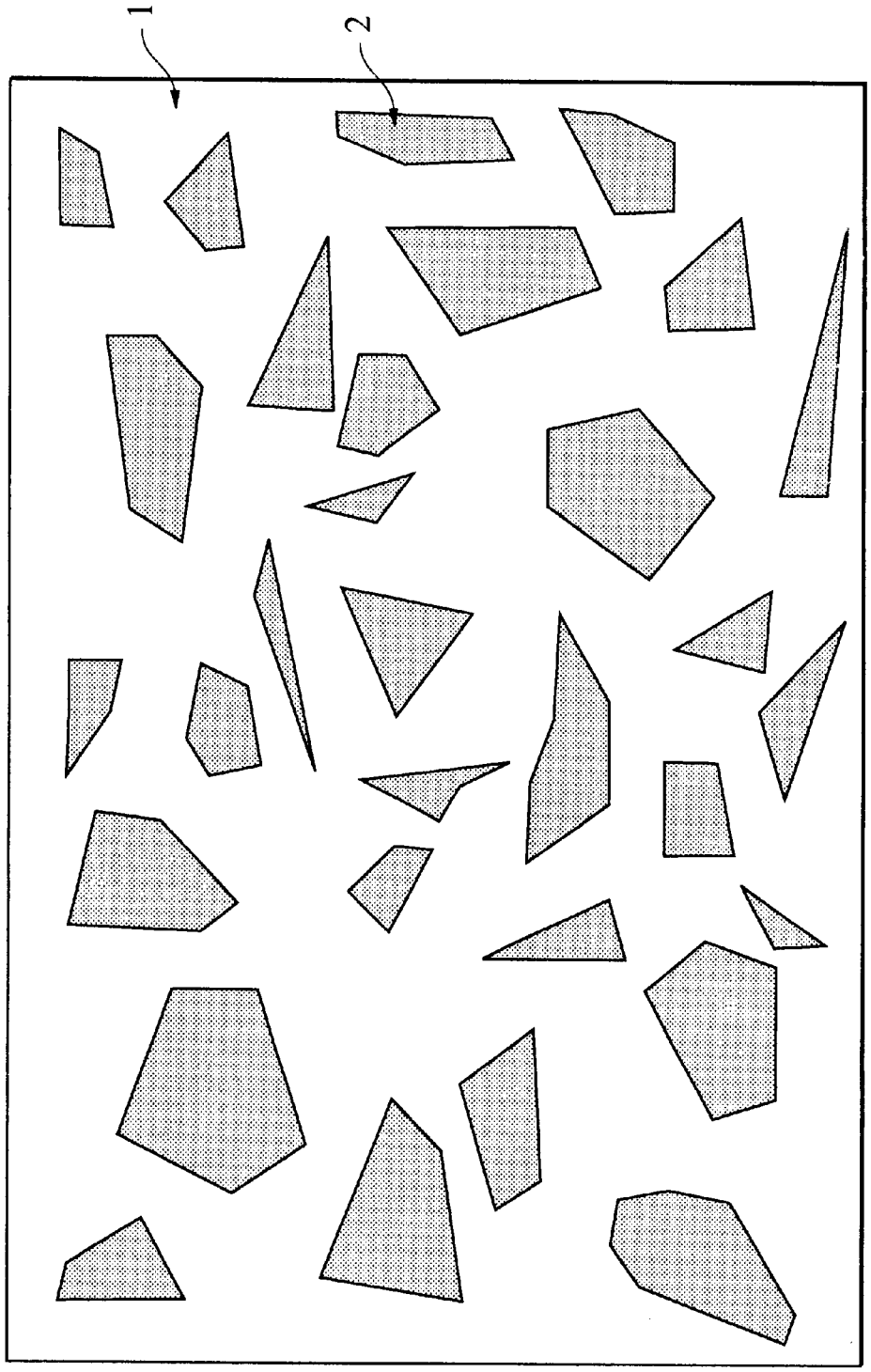
FIG. 2 is an enlarged view schematically showing another exemplary surface state of the recording medium according to the present invention.

In one example shown in FIG. 1, the base paper is denoted by numeral 2, and the shape of each island of the ink accepting layer, denoted by numeral 2, is rectangular, but the island shape is not limited thereto. The ink accepting layer may be scattered on the surface of the base paper, denoted by numeral 1, in the form of islands 2 having any shape, e.g., random shapes as shown in FIG. 2.

When the ink accepting layer is scattered in the form of islands on the surface of the base paper, the mean size of each island of the ink accepting layer is in the range of 3 to 250 $\mu$m, more preferably in the range of 5 to 100 $\mu$m. If the mean size of the islands of the ink accepting layer is too small, reflected light would be so strongly scattered that the recording medium appears like a mat surface. If the mean size of the islands of the ink accepting layer is too large, there is a possibility that the resolution may deteriorate.

The mean size of the islands of the ink accepting layer was determined as follows. The surface of a fabricated recording medium was observed using a light microscope or a scanning electron microscope at such a maximum magnification that 200 or more islands of the ink accepting layer can be discerned. Long and short axes of each island of the ink accepting layer formed on the base paper were measured, and a value of (long axis+short axis)/2 was obtained as the size of each island of the ink accepting layer. Then, a mean value of the sizes of 200 islands of the ink accepting layer was determined as the mean size of the islands of the ink accepting layer.

The coverage of the ink accepting layer over the base paper is preferably not less than 30% but less than 70%, more preferably not less than 50% but less than 70%. If the coverage is too small, there is a possibility that the image density may be reduced. If the coverage is too large, the exposed area of the base paper would be so reduced that the natural characteristics of the base paper and ease in handling may be impaired.

When the size of the islands of the ink accepting layer is evaluated using the mean size, the coverage can be calculated from the following formula;

$$B(C/2)^2\pi/A\times 100(\%)$$

where

A is the area observed by the microscope,

B is the number of islands of the ink accepting layer per the area A, and

C is the mean size of the of the islands of the ink accepting layer.

By scattering the ink accepting layer in the form of islands on the base paper and keeping the islands disconnected from one another while satisfying the above conditions, it is possible to provide a recording medium that maintains the natural characteristics of the base paper, and ensures a high image density, a sharp color tone and a high resolution, while developing good ink absorption.

Materials of the ink accepting layer will be described below.

Materials of the ink accepting layer are determined with respect to the type of ink used. Though not particularly limited, an inorganic pigment is preferably employed, taking into account fixation and absorption of the ink. The inorganic pigment can be selected from, for example, silica, zeolite, calcium carbonate, diatomite, kaolin clay, baked clay, talc, aluminum hydroxide, colloidal alumina, alumina, alumina hydrate, barium sulfate, titanium dioxide, zinc oxide, magnesium silicate, magnesium carbonate, hydrotalcites, and so on which are conventionally used in a coating layer of general coated paper. In the present invention, these inorganic pigments can be employed alone or as a mixture of two or more selected therefrom. Especially preferable pigments are an alumina hydrate and silica.

In addition to the above inorganic pigment, a binder is added to the ink accepting layer to increase adhesion between the pigment particles and between the pigment and the base paper. As the binder, one or more kinds of water-soluble high-molecular weight polymers and water-dispersant high-molecular weight polymers are optionally selected for use. Preferable examples of the binder are water-soluble high-molecular weight polymers including polyvinyl alcohol or denatured polyvinyl alcohol, starch or denatured starch, gelatin or denatured gelatin, casein or denatured casein, gum arabic, cellulose derivatives such as carboxymethyl cellulose, polyvinyl pyrrolidone, maleic anhydrate or copolymers thereof, and acrylic ester copolymers; and water-dispersant high-molecular weight polymers including conjugated diene-based copolymer latex such as SBR latex, functional-group denatured copolymer latex, and vinyl-based copolymer latex such as ethylene vinyl acetate.

A mixing ratio of the inorganic pigment to the binder by weight is preferably in the range of 5:1 to 20:1. Within this range, the ink accepting layer shows a high ink absorption rate and a high image density is obtained in a printed area. If the amount of binder is too small, the so-called "powder dropping" tends to occur easily. If the amount of binder is too large, the pore volume in the ink accepting layer would be so reduced as to lower the ink absorptivity.

In addition to the inorganic pigment and the binder, the ink accepting layer in the present invention may also contain, if necessary, a pigment dispersant, a viscosity intensifier, a pH adjuster, a lubricant, a fluidity denaturant, a surfactant, a defoamer, an anti-hydration agent, a foam suppressor, a releasing agent, a foamer, a penetrant, a coloring dye, a fluorescence whitener, a ultraviolet absorber, an antioxidant, an antiseptic agent, and a fungicide. The anti-hydration agent can be optionally selected from well-known materials such as halogenated quaternary ammonium salts and quaternary ammonium salt polymers.

The method of scattering the ink accepting layer in the form of islands on the base paper is not particularly limited, and the ink accepting layer can be formed on the base paper by a pattern printing method such as screen printing, flexography or gravure. As a matter of course, the ink accepting layer can also be formed by an ink jet recording method to which the present invention pertains.

The amount of the ink accepting layer coated on the base paper in the present invention is preferably in the range of 0.1 to 10 g/m$^2$. If the amount of the ink accepting layer is too large, there is a possibility that the natural characteristics of the base paper may be lost. Conversely, if the amount of the ink accepting layer is too small, there is a possibility that the image density may be reduced.

Ink used primarily contains a coloring material (dye or pigment), a water-soluble organic solvent, and water. The dye is preferably any of water-soluble dyes represented by, e.g., direct dyes, acid dyes, basic dyes, reactive dyes, and edible coloring matters. Any type of dye can be used so long as it can produce an image satisfying desired requirements for fixation, sharpness, stability, resistance to light, etc. in combination with the recording medium described above. The pigment can be applied by a method of using a dispersant in combination, a method of using a self-dispersive pigment, or a method of using microcapsules.

A water-soluble dye is generally employed by dissolving the dye in a solvent comprising water alone or a mixture of water and a water-soluble organic solvent. A mixture of water, various water-soluble organic solvents, etc. is preferably used as the solvent component. Also, the amount of the solvent is preferably adjusted so that the water content of the ink falls in the range of 20 to 90%.

Examples of the water-soluble organic solvent include alkyl alcohols having a carbon number of 1 to 4 such as methylalcohol, amides such as dimethylformamide, ketones or ketone alcohols such as acetone, ethers such as tetrahydrofuran, polyalkylene glycols such as polyethylene glycol, alkylene glycols with an alkylene group having a carbon number of 2 to 6 such as ethylene glycol, and lower alkyl ethers of polyhydric alcohols such as glycerin and ethylene glycol methyl ether. Of these water-soluble organic solvents, polyhydric alcohols such as diethylene glycol and lower alkyl ethers of polyhydric alcohols such as triethylene glycol monomethyl ether are preferable. Polyhydric alcohols are especially preferable due to their effect as a lubricant to prevent clogging of nozzles caused by the fact that water in the ink evaporates and a water-soluble dye precipitates.

A solubilizer can be added to the ink. The solubilizer is typically represented by heterocyclic ketones containing nitrogen, and is intended to act to drastically improve solubility of a water-soluble dye for a solvent. For example, N-methyl-2-pyrrolidone and 1,3-dimethyl-2-imidazolidinone are preferably employed. Other additives, such as a viscosity adjuster, a surfactant, a surface tension adjuster, a pH adjuster and a specific resistance adjuster, may be further added to the ink for the purpose of improving ink characteristics.

An ink jet recording method is especially preferably employed as a method for applying the ink onto the recording medium to produce an image. Any type of ink jet recording method is usable so long as the method can effectively eject the ink through fine nozzles and apply ink droplets onto the recording medium. In particular, the ink jet recording method disclosed in Japanese Patent Laid-Open No. 54-59936, in which ink causes an abrupt volumetric change due to the action of thermal energy and ink droplets are ejected through nozzles due to forces generated by such a state change, is most effectively used in the present invention.

Additionally, the recording medium of the present invention is also usable with other image forming methods (e.g., electrophotography and other various printing methods).

EXAMPLES

The present invention will be described below more concretely in conjunction with Examples, but it is of course to be understood that the present invention is not limited to the following Examples. Note that the bulk weight and the Stökigt sizing degree of the base paper were measured in conformity with JIS P 8124 and JIS P 8122, respectively.

Examples 1 to 5

In these Examples, the present invention was implemented with the Stökigt sizing degree (calculated in terms of bulk weight of 127 g/m$^2$) of the base paper being a variable.

An ink accepting layer was formed on each piece of base paper by printing a coating solution, which had a composition as listed below, with a 420-mesh screen plate such that the coating thickness was 4 g/m$^2$ calculated in terms of dried solid. The ink accepting layer was then dried in an oven at 80° C. for 15 minutes, whereby recording media 1 to 5 were fabricated.

Surface states of the thus-fabricated recording media 1 to 5 were observed by a scanning electron microscope (hereinafter referred to as "SEM"). As a result, it was confirmed that the recording media 1 to 5 had substantially the same ink accepting layers, i.e., that the ink accepting layers had a regular lattice pattern as schematically illustrated in FIG. 1, scattered islands of the ink accepting layers had a mean size of 27 to 36 $\mu$m, and surface coverages of the ink accepting layers were 47 to 55%.

Table 1 lists measured characteristics of the recording media 1 to 5. In Example 2 in which the Stökigt sizing degree has a large value, the index (beading) of ink fixation is comparatively inferior. This is presumably attributable to the fact that the ink was not sufficiently absorbed by the base paper.

Also, in Example 5 in which the Stökigt sizing degree has a small value, the image density is comparatively inferior. This is presumably attributable to the fact that the ink was diffused deep into the base paper.

The composition of the coating solution used in these examples is below:

| | |
|---|---|
| γ-alumina (by Sumitomo Chemical Co., Ltd., AKP-G015) | 1 part |
| polyvinyl alcohol (by Kuraray Co., Ltd., PVA 117) | 1 part |
| noniphenol-base surfactant (by Sanyo Chemical Industries Co., Ltd., Nonipol 85) | 2 parts |
| water | 20 parts |

Examples 6, 7

Recording media 6 and 7 were fabricated under the same conditions as in Example 1 except that screen printing was performed with a 200-mesh screen (Example 6) and a 80-mesh screen (Example 7). In these Examples, the present invention was implemented with the mean size of the islands of the ink accepting layer being a variable.

As with Example 1, surface states of the recording media 6 and 7 were observed by a scanning electron microscope. As a result, it was confirmed that each ink accepting layer had a regular lattice pattern (FIG. 1). The mean size of the islands and the surface coverage of the islands of the ink accepting layer of each recording medium are listed in Table 1.

In Example 7, in which the mean size of the islands of the ink accepting layer is maximum, not only the natural characteristics of the base paper, but also feathering (indicating some ink diffusion in the two-dimensional directions along the paper surface) are somewhat inferior. This is presumably attributable to the fact that, because the mean size of the islands of the ink accepting layer has a very large value of 0.2 mm, the ink is diffused within the ink accepting layer in the two-dimensional directions along the paper surface.

Example 8

An ink accepting layer was formed on a piece of base paper, which had a bulk weight of 127 g/m$^2$ and a Stökigt sizing degree of 128 sec, by printing a coating solution, which had a composition (calculated in terms of solid weight) as listed below, with a 420-mesh screen plate such that the coating thickness was 3 g/m$^2$ calculated in terms of dried solids. The ink accepting layer was then dried in an oven at 80° C. for 15 minutes, whereby a recording medium 8 was fabricated.

As with Example 1, a surface state of the thus-fabricated recording medium 8 was observed by a scanning electron microscope. As a result, it was confirmed that the ink accepting layer had a regular lattice pattern. The mean size of the islands and the surface coverage of the ink accepting layer are listed in Table 1.

The composition of the coating solution used in this example is given below:

| | |
|---|---|
| γ-alumina (by Sumitomo Chemical Co., Ltd., AKP-G015) | 5 parts |
| SBR latex (by Dai-Nippon Ink & Chemicals Co., Ltd., DS-226) | 5 parts |
| quaternary ammonium salt-base water soluble resin (Nagase Kasei Co., Ltd., WEISSTEX 90) | 1 part |

-continued

| | |
|---|---|
| noniphenol-base surfactant (by Sanyo Chemical Industries Co., Ltd., Nonipol 85) | 2 parts |
| water | 20 parts |

Example 9

A recording medium 9 was fabricated in the same manner as in Example 8 except for using a coating solution that had the composition listed below. As with Example 1, a surface state of the thus-fabricated recording medium 9 was observed by a scanning electron microscope. As a result, it was confirmed that the ink accepting layer had a regular lattice pattern. The mean size of the islands and the surface coverage of the ink accepting layer are listed in Table 1.

The composition of the coating solution used in this example is given below:

| | |
|---|---|
| γ-alumina (by Sumitomo Chemical Co., Ltd., AKP-G015) | 5 parts |
| SBR latex (by Dai-Nippon Ink & Chemicals Co., Ltd., DS-226) | 6 parts |
| quaternary ammonium salt-base water soluble resin (Nagase Kasei Co., Ltd., WEISSTEX 90) | 1.2 part |
| noniphenol-base surfactant (by Sanyo Chemical Industries Co., Ltd., Nonipol 85) | 2 parts |
| water | 20 parts |

Comparative Examples 1 to 3

Recording media 10 to 12 were fabricated using pieces of base paper having respective values of the Stökigt sizing degree shown in Table 1 and the same coating solution as used in Example 1. More specifically, an ink accepting layer was formed over the entire surface of each piece of base paper by a wire bar such that a coating thickness was 4 g/m$^2$ calculated in terms of dried solid. The ink accepting layer was then dried in an oven at 80° C. for 15 minutes. As with Example 1, surface states of the thus-fabricated recording media were observed by a scanning electron microscope. As a result, it was confirmed that the ink accepting layer was uniformly formed on the base paper.

In each of the recording media 10 to 12, because the ink accepting layer was formed over the entire surface of the base paper, the natural characteristics of the base paper were mostly lost. Also, feathering, indicating some extent of ink diffusion in the two-dimensional directions along the paper surface, was significantly inferior in each of the recording media 10 to 12 wherein the base paper is entirely coated with the ink accepting layer.

TABLE 1

| | Mean Size of Islands Ink Accepting Layer (μm) | Coverage of Ink Accepting Layer (%) | Sizing Degree of Base Paper (sec) | Natural Characteristics of Base Paper | Ink Absorption Feathering | Ink Absorption Beading | Ink Absorption Image Density |
|---|---|---|---|---|---|---|---|
| Example 1 Recording Medium 1 | 32 | 48 | 128 | ⊙ | ⊙ | ⊙ | ⊙ |
| Example 2 Recording Medium 2 | 36 | 55 | 560 | ⊙ | ⊙ | ○ | ⊙ |
| Example 3 Recording Medium 3 | 35 | 52 | 392 | ⊙ | ⊙ | ⊙ | ⊙ |
| Example 4 Recording Medium 4 | 28 | 48 | 10 | ⊙ | ⊙ | ⊙ | ⊙ |
| Example 5 Recording Medium 5 | 27 | 47 | 2 | ⊙ | ⊙ | ⊙ | ○ |
| Example 6 Recording Medium 6 | 95 | 68 | 128 | ⊙ | ⊙ | ⊙ | ⊙ |
| Example 7 Recording Medium 7 | 215 | 78 | 128 | ○ | ○ | ⊙ | ⊙ |
| Example 8 Recording Medium 8 | 20 | 30 | 128 | ⊙ | ⊙ | ⊙ | ⊙ |
| Example 9 Recording Medium 9 | 18 | 26 | 128 | ⊙ | ⊙ | ⊙ | ○ |
| Com.Ex. 1 Recording Medium 10 | — | Full Coverage | 128 | Δ | Δ | ⊙ | ⊙ |
| Com.Ex. 2 Recording Medium 11 | — | Full Coverage | 10 | Δ | x | ⊙ | ⊙ |
| Com.Ex. 3 Recording Medium 12 | — | Full Coverage | 392 | Δ | ○ | Δ | ⊙ |

Evaluation criteria for the items in Table 1 are as follows.

<Natural Characteristics>

For the recording media 1 to 12 fabricated as described above, the natural characteristics of each recording medium were evaluated by visual observation and touch in accordance with the following criteria:

⊙: the presence of the ink accepting layer cannot be recognized by both visual observation and touch, ○: the presence of the ink accepting layer can be barely recognized by visual observation, Δ: the presence of the ink accepting layer can be barely recognized by visual observation, and a rougher feeling slightly different from the feel of the base paper is perceived by touch, and ×: the presence of the ink accepting layer can be clearly recognized.

<Evaluation of Ink Absorption>

For the recording media 1 to 12 fabricated as described above, various images were printed on them by using an ink jet printer (Trade Name: BJC430J, by Canon Inc.), and the quality of the images printed on the recording media was evaluated for the following items.

(Feathering)

A full-solid image of 100% duty forming dots in all pixels was printed using each of inks Bk, Y, M and C, and feathering in a green area (uneven diffusion of the ink in the two-dimensional directions in the printed area) was evaluated in accordance with the following criteria:

⊙: no feathering is found,

○: feathering less than 0.1 mm is found,

Δ: feathering not less than 0.1 mm but less than 0.2 mm is found, and

×: feathering not less than 0.2 mm is found.

(Ink Absorptivity, Beading)

A full-solid image of 100% duty forming dots in all pixels was printed using each of inks Bk, Y, M and C. Dryness of the printed area immediately after the formation of the image and beading after leaving the recording medium to stand for 24 hours were evaluated in accordance with the following criteria:

⊙: no ink adheres to the hand upon touching the printed area even immediately after the formation of the image, the surface of the printed area is uniform, and unevenness of image density (beading) is not found, ○: a small amount of ink adheres to the hand upon touching the printed area immediately after the formation of the image, but the surface of the printed area is uniform and unevenness of image density (beading) is not found, Δ: a small amount of ink adheres to the hand upon touching the printed area immediately after the formation of the image, and slight unevenness of image density (beading) is found on the surface of the printed area, and ×: a small amount of ink adheres to the hand upon touching the printed area immediately after the formation of the image, and significant unevenness of image density (beading) is found on the surface of the printed area.

(Image Density)

A full-solid image of 100% duty forming dots in all pixels was printed using each of inks Bk, Y, M and C. After leaving the recording medium to stand for 24 hours, the image density was measured using a reflecting densitometer (Macbeth RD918, by Macbeth Co.) and was evaluated in accordance with the following criteria:

⊙: not less than 1.4,

○: not less than 1.2 but less than 1.4,

Δ: not less than 1.0 but less than 1.2, and

×: less than 1.0.

The present invention provides the following advantages.

1. Since the ink accepting layer is coated in a small amount and is scattered in the form of islands so as to make the base paper partly exposed, the natural characteristics of the base paper and ease in handling can be maintained with fidelity.

2. Since the ink accepting layer is scattered in the form of islands, diffusion of ink in the two-dimensional directions along the paper surface is suppressed even when a large amount of ink is concentrated in a particular area. As a result, a recording medium capable of ensuring a high image density, a sharp color tone and a high resolution is obtained.

While the present invention has been described with reference to what are presently considered to be the preferred embodiments, it is to be understood that the invention is not limited to the disclosed embodiments. To the contrary, the invention is intended to cover various modifications and equivalent arrangements, included within the spirit and scope of the appended claims. The scope of the following claims is to be accorded the broadest interpretation so as to encompass all such modifications and equivalent structures and functions.

What is claimed is:

1. A recording medium comprising multiple kinds of ink accepting layers formed on at least one surface of a base paper, wherein the multiple kinds of ink accepting layers have different absorption properties and each ink accepting layer is formed in the form of islands scattered on the surface of the base paper, and wherein the coverage ratio of the total area of said ink accepting layers, calculated using the mean size of individual islands of said ink accepting layers, to the surface area of said base paper is at least 30% and less than 70%.

2. A recording medium according to claim 1, wherein the total amount of said ink accepting layers coated on said base paper is in the range of 0.1 to 10 $g/m^2$.

3. A recording medium according to claim 1, wherein the mean size of 200 islands of the ink accepting layers is in the range of 3 to 250 $\mu$m, when the size of each island is represented by the mean value of long and short axes of the island.

4. A recording medium according to claim 1, wherein the base paper has a Stökigt sizing degree in the range of 10 to 400 seconds.

5. An ink jet recording method in which ink droplets are ejected through fine orifices and deposited on a recording medium according to any one of claims 1–4.

6. An ink jet recording method according to claim 5, wherein the ink droplets are ejected upon volumetric expansion of ink due to heating of the ink.

7. An ink jet recording method according to claim 5, wherein the ink contains at least a coloring material, a water-soluble organic solvent, and water.

8. A method of producing a recording medium according to any one of claims 1–4 wherein the ink accepting layers scattered in the form of islands on the base paper are formed on said base paper by a pattern printing method.

* * * * *

UNITED STATES PATENT AND TRADEMARK OFFICE

CERTIFICATE OF CORRECTION

PATENT NO. : 6,663,922 B2
DATED : December 16, 2003
INVENTOR(S) : Ogino, Hiroyuki It is certified that error appears in the above-identified patent and that said Letters Patent is hereby corrected as shown below:

Column 1,
Line 10, “image etc.” should read -- image, etc, --.
Line 20, “Etc.” should read -- etc., --.

Column 6,
Line 29, “of the” (second occurance) should be deleted.

Column 7,
Line 18, “a” (second occurrence) should read -- an --.

Column 9,
Line 17, “a” (second occurance) should read -- an --.

Signed and Sealed this

Eighth Day of June, 2004

JON W. DUDAS
*Acting Director of the United States Patent and Trademark Office*